US009187988B2

(12) United States Patent
Abedrabbo et al.

(10) Patent No.: US 9,187,988 B2
(45) Date of Patent: Nov. 17, 2015

(54) COMPLIANT CONE SYSTEM

(75) Inventors: Nader Elias Abedrabbo, Cypress, TX (US); Varadaraju Gandikota, Cypress, TX (US); Lev Ring, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 722 days.

(21) Appl. No.: 13/485,379

(22) Filed: May 31, 2012

(65) Prior Publication Data

US 2013/0319692 A1 Dec. 5, 2013

(51) Int. Cl.

| | |
|---|---|
| ***E21B 23/00*** | (2006.01) |
| ***E21B 19/00*** | (2006.01) |
| ***E21B 43/10*** | (2006.01) |

(52) U.S. Cl.

CPC ..... *E21B 43/10* (2013.01)

(58) Field of Classification Search

CPC ... E21B 43/103; E21B 43/105; E21B 43/108; E21B 33/12955; E21B 43/10

USPC ..... 166/207, 217, 206, 384

See application file for complete search history.

(56) References Cited

U.S. PATENT DOCUMENTS

| | | | | |
|---|---|---|---|---|
| 1,981,525 | A | 11/1934 | Price | |
| 2,178,999 | A | 11/1939 | Scott | |
| 3,203,451 | A | 8/1965 | Vincent | |
| 3,785,193 | A | 1/1974 | Kinley et al. | |
| 6,012,523 | A | 1/2000 | Campbell et al. | |
| 6,457,532 | B1 | 10/2002 | Simpson | |
| 6,648,075 | B2 | 11/2003 | Badrak et al. | |
| 6,688,397 | B2 | 2/2004 | McClurkin et al. | |
| 6,702,030 | B2 * | 3/2004 | Simpson | 166/380 |
| 6,722,441 | B2 | 4/2004 | Lauritzen et al. | |
| 6,763,893 | B2 | 7/2004 | Braddick | |
| 7,111,680 | B2 | 9/2006 | Duggan | |
| 7,117,940 | B2 | 10/2006 | Campo | |
| 7,121,351 | B2 | 10/2006 | Luke et al. | |
| 7,434,622 | B2 | 10/2008 | Luke et al. | |
| 2001/0020532 | A1 | 9/2001 | Baugh et al. | |
| 2002/0040788 | A1 * | 4/2002 | Hill et al. | 166/382 |
| 2003/0042022 | A1 * | 3/2003 | Lauritzen et al. | 166/277 |
| 2003/0075337 | A1 * | 4/2003 | Maguire | 166/380 |
| 2003/0121655 | A1 | 7/2003 | Lauritzen et al. | |
| 2003/0155118 | A1 | 8/2003 | Sonnier et al. | |
| 2003/0168222 | A1 * | 9/2003 | Maguire et al. | 166/380 |
| 2004/0016544 | A1 | 1/2004 | Braddick | |

(Continued)

FOREIGN PATENT DOCUMENTS

| | | |
|---|---|---|
| GB | 2 401 127 A | 11/2004 |
| GB | 2 413 577 A | 11/2005 |

(Continued)

*Primary Examiner* — Shane Bomar
*Assistant Examiner* — Michael Wills, III
(74) *Attorney, Agent, or Firm* — Patterson & Sheridan, L.L.P.

(57) ABSTRACT

The present invention generally relates to a cone system having a cone segment capable of deflecting in response to a restriction or obstruction encountered while expanding a tubular. In one aspect, an expansion cone system is provided. The expansion cone system includes a mandrel and two or more pockets disposed circumferentially around the mandrel. Each pocket is at least partially defined by a fin member. The expansion cone system further includes a cone segment coupled to each pocket. Additionally, the expansion cone system includes a biasing member disposed between the mandrel and the respective cone segment. In another aspect, a method of expanding a wellbore tubular is provided.

26 Claims, 10 Drawing Sheets

(56) References Cited

U.S. PATENT DOCUMENTS

| | | | | |
|---|---|---|---|---|
| 2004/0168796 | A1 | 9/2004 | Baugh et al. | |
| 2005/0194151 | A1 | 9/2005 | Dewey et al. | |
| 2006/0196679 | A1 | 9/2006 | Brisco et al. | |
| 2006/0266530 | A1* | 11/2006 | Echols | 166/387 |
| 2010/0089591 | A1* | 4/2010 | Thomson et al. | 166/382 |
| 2010/0089592 | A1* | 4/2010 | Ring et al. | 166/384 |
| 2012/0037381 | A1* | 2/2012 | Giroux et al. | 166/382 |

FOREIGN PATENT DOCUMENTS

| | | | |
|---|---|---|---|
| WO | 02/059456 | | 8/2002 |
| WO | 03/006790 | A1 | 1/2003 |
| WO | 03/016669 | A2 | 2/2003 |
| WO | 2004/079157 | A1 | 9/2004 |

* cited by examiner

COMPLIANT CONE SYSTEM

BACKGROUND OF THE INVENTION

1. Field of the Invention

Embodiments of the invention generally relate to apparatus and methods for expanding a tubular in a wellbore. More particularly, embodiments of the invention relate to a compliant cone system.

2. Description of the Related Art

Hydrocarbon wells are typically initially formed by drilling a borehole from the earth's surface through subterranean formations to a selected depth in order to intersect one or more hydrocarbon bearing formations. Steel casing lines the borehole, and an annular area between the casing and the borehole is filled with cement to further support and form the wellbore. Several known procedures during completion of the wellbore utilize some type of tubular that is expanded downhole, in situ. For example, a tubular can hang from a string of casing by expanding a portion of the tubular into frictional contact with a lower portion of the casing therearound. Additional applications for the expansion of downhole tubulars include expandable open-hole or cased-hole patches, expandable liners for mono-bore wells, expandable sand screens and expandable seats.

Various expansion devices exist in order to expand these tubulars downhole. Typically, expansion operations include pushing or pulling a fixed diameter cone through the tubular in order to expand the tubular to a larger diameter based on a fixed maximum diameter of the cone. However, the fixed diameter cone provides no flexibility in the radially inward direction to allow for variations in the internal diameter of the casing. For instance, due to tolerances, the internal diameter of the casing may vary by 0.25" or more, depending on the size of the casing. There are also variations of casing weights which have same outer diameters, but different inner diameters. Furthermore, a section of the well might have a single weight casing, but the inner diameter of the casing might have rust buildup, scale buildup, or other types of restrictions of the inner diameter. This variation in the internal diameter of the casing can cause the fixed diameter cone to become stuck in the wellbore, if the variation is on the low side. A stuck fixed diameter cone creates a major, time-consuming and costly problem that can necessitate a sidetrack of the wellbore since the solid cone cannot be retrieved from the well and the cone is too hard to mill up. Further, this variation in the internal diameter of the casing can also cause an inadequate expansion of the tubular in the casing if the variation is on the high side, which may result in an inadequate coupling between the tubular and the casing.

Thus, there exists a need for an improved compliant cone system capable of expanding a tubular while compensating for variations in the internal diameter of the casing.

SUMMARY OF THE INVENTION

The present invention generally relates to a cone system having a cone segment capable of deflecting in response to a restriction or obstruction encountered while expanding a tubular. In one aspect, an expansion cone system is provided. The expansion cone system includes a mandrel and two or more pockets disposed circumferentially around the mandrel. Each pocket is at least partially defined by a fin member. The expansion cone system further includes a cone segment coupled to each pocket. Additionally, the expansion cone system includes a biasing member disposed between the mandrel and the respective cone segment.

In another aspect, an expansion cone system for expanding a tubular is provided. The expansion cone system includes a mandrel and a plurality of fin members disposed circumferentially around the mandrel. The expansion cone system further includes a cone segment disposed between two adjacent fin members. Additionally, the expansion cone system includes an energy absorbing member disposed between the mandrel and the respective cone segment.

In yet another aspect, an expansion cone for expanding a tubular is provided. The expansion cone includes a mandrel and two or more pockets disposed circumferentially around the mandrel. Each pocket configured to contain an energy absorbing mechanism. The expansion cone further includes a cone segment that interacts with the energy absorbing mechanism. Each cone segment being individually movable between an initial shape where the expansion cone has a first diameter, and a collapsed shape where the expansion cone has a smaller, second diameter.

In a further aspect, a method of expanding a wellbore tubular is provided. The method includes the step of positioning an expansion cone system in the wellbore tubular, wherein the expansion cone system comprises two or more pockets disposed circumferentially around a mandrel, and a biasing member and a cone segment disposed in each pocket. The method further includes the step of expanding a portion of the wellbore tubular by utilizing the cone segment of the expansion cone system in a first configuration. The method also includes the step of encountering a restriction to expansion which causes the cone segment of the expansion cone system to deform the biasing member and change into a second configuration. Additionally, the method includes the step of expanding another portion of the wellbore tubular by utilizing the cone segment in the second configuration.

In a further aspect, an expansion cone for expanding a tubular is provided. The expansion cone system includes two or more pockets disposed circumferentially around a mandrel. Each pocket is configured to contain an energy absorbing mechanism, wherein each energy absorbing mechanism is separated by a fin member. The expansion cone system further includes a cone segment that interacts with each pocket. Each cone segment is individually movable in the pocket between an original shape and a collapsed shape, wherein the expansion cone has a first diameter when the cone segment is in the original shape and a second diameter that is smaller than the first diameter when the cone segment is in the collapsed shape.

In yet another aspect, an expansion cone system is provided. The expansion cone system includes a mandrel, a cone segment and a plurality of fin members disposed circumferentially around the mandrel. The expansion cone system further includes an energy absorbing member disposed between the mandrel and the cone segment and between two adjacent fin members, wherein expansion of the energy absorbing member is constrained by the two adjacent fin members.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the invention generally relate to a cone system having a cone segment capable of deflecting in response to a restriction (or obstruction) encountered while expanding a tubular, and returning to an original shape when the restriction is passed. While in the following description the tubular is illustrated as a liner in a casing string, the tubular can be any type of downhole tubular. For example, the tubular may be an open-hole patch, a cased-hole patch or an expandable sand screen. Although the tubular is illustrated herein as being expanded in the casing string, the tubular may also be expanded into an open-hole. To better understand the aspects of the cone system of the present invention and the methods of use thereof, reference is hereafter made to the accompanying drawings.

Figure 1:
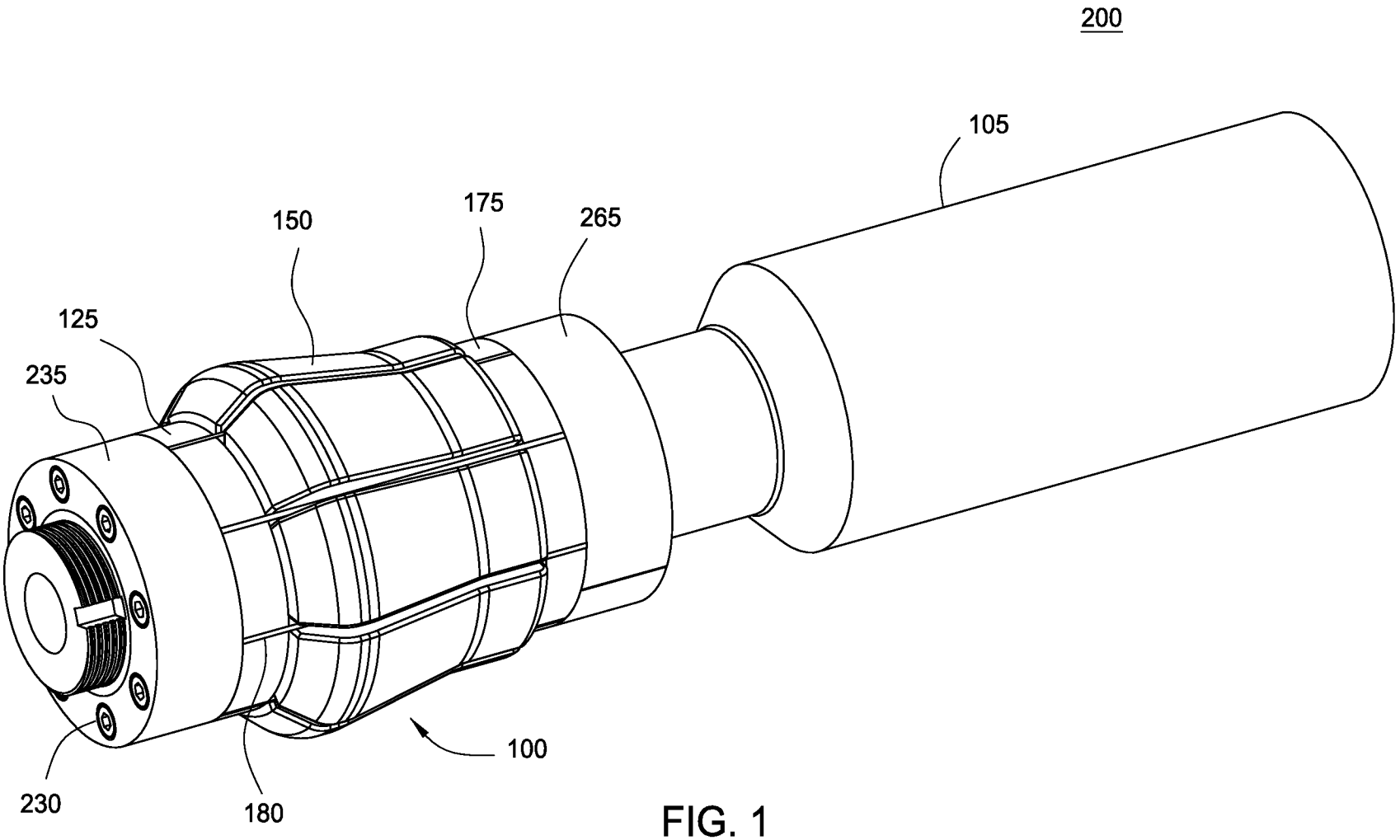
FIG. 1 is an isometric view illustrating an expansion assembly according to one embodiment of the invention.

FIG. 1 is an isometric view illustrating an expansion assembly 200 according to one embodiment of the invention. The expansion assembly 200 is configured to expand a tubular in a wellbore. The expansion assembly 200 includes a connection member 105 to connect the expansion assembly 200 to a work string (not shown). The expansion assembly 200 further includes a compliant cone system 100 to expand the tubular as the work string moves the expansion assembly 200 through the tubular. As will be described herein, the compliant cone system 100 includes a plurality of cone segments 150 that are configured to move radially relative to a first end member 125 and a second end member 175. Each cone segment 150 is independently movable in the compliant cone system 100.

Figure 2:
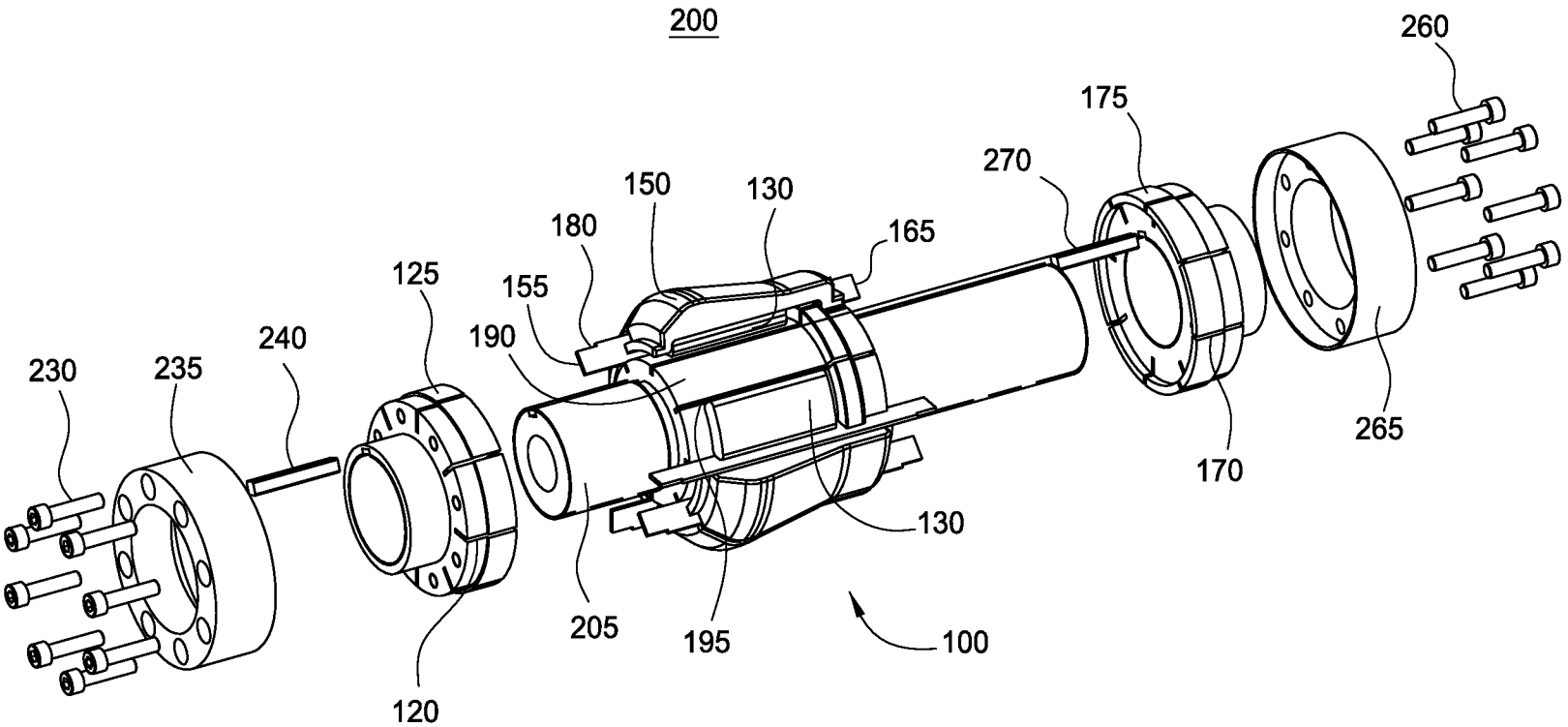
FIG. 2 is an exploded view of the expansion assembly of FIG. 1.

FIG. 2 is an exploded view of the expansion assembly 200 of FIG. 1. As shown, the first end member 125 is attached to a mandrel 205 by means of threads and a key 240. A cap 235 is used as a holder for fins 180 along with a plurality of connection members 230. The second end member 175 is attached to the mandrel 205 by means of threads and a key 270. A cap 265 is used as a holder for the fins 180 along with a plurality of connection members 260.

The compliant cone system 100 includes a biasing member 130 under each cone segment 150. The biasing member 130 is configured to bias the cone segment 150 radially outward. Each biasing member 130 and cone segment 150 are disposed in a pocket 160 (FIG. 4B) on a cone mandrel 190. The pocket 160 is configured as a containment system for containing the biasing member 130. As will be described herein, the biasing member 130 will expand and retract in the pocket 160 as the cone segment 150 moves radially between a first shape and a second contracted shape. In other words, the pocket 160 acts as a boundary around (or contains) the biasing member 130 as the biasing member 130 expands and retracts.

The pocket 160 is at least partially defined by fins 180. A first end 155 of each fin 180 engages a groove 120 in the first end member 125 and a second end 165 of each fin 180 engages a groove 170 in the second end member 175. A lower portion of the each fin 180 is configured to engage a groove 195 in the cone mandrel 190. The fin 180 is substantially straight and may be made from a composite material, metallic material or any other suitable material.

Figure 3:
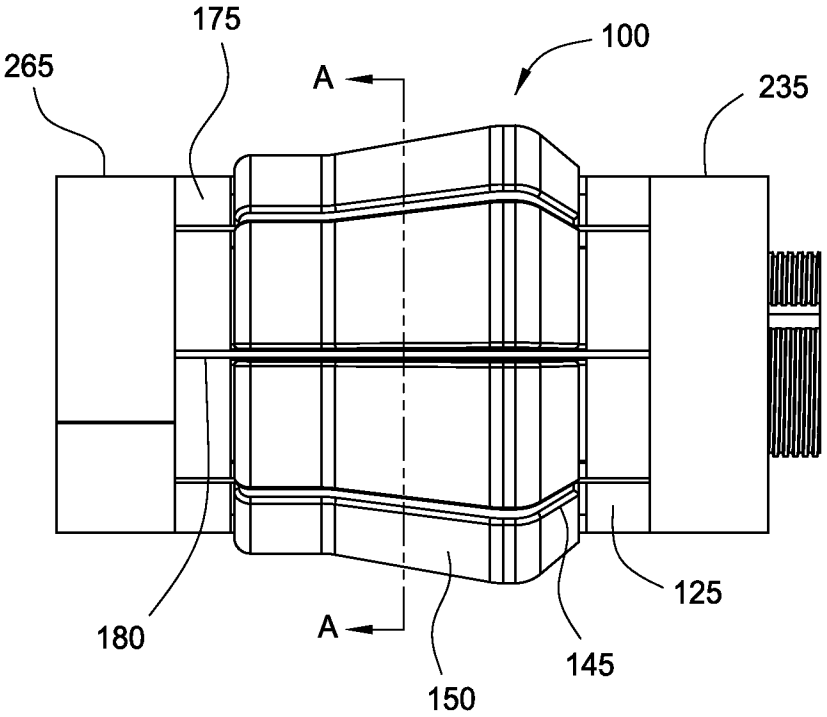
FIG. 3 is a view illustrating a compliant cone system of the expansion assembly.

FIG. 3 is a view illustrating the compliant cone system 100 of the expansion assembly 200. The cone segments 150 are circumferentially disposed around the cone mandrel 190. Prior to the manufacturing process of the cone segments 150, an analysis of the compliant cone design is carried out by FEA analysis to ensure that the cone inner diameter and outer diameter are adequate for each job. Compared to a job that uses a solid cone, the segmented cone design would typically have a larger outer diameter. During the manufacturing process, a solid cone is divided into smaller segments by performing precision cutting of the solid cone (usually by EDM process) into the desired number of segments.

The cone segments 150 are configured to expand a tubular in a substantially compliant manner in which the cone segments 150 move between the first shape and the second contracted shape, as the compliant cone system 100 moves through the tubular. For instance, as the cone segment 150 contacts the inner diameter of the tubular proximate a restriction, the cone segment 150 may contract from the first shape (or move radially inward) to the second contracted shape and then return to the first shape (or move radially outward) as the compliant cone system 100 moves through the tubular. As the cone segment 150 moves between the first shape and the second contracted shape, the biasing member 130 flexes. In this configuration, the force acting on the inner diameter of the tubular may vary due to the compliant nature of the biasing member 130.

Figure 3A:
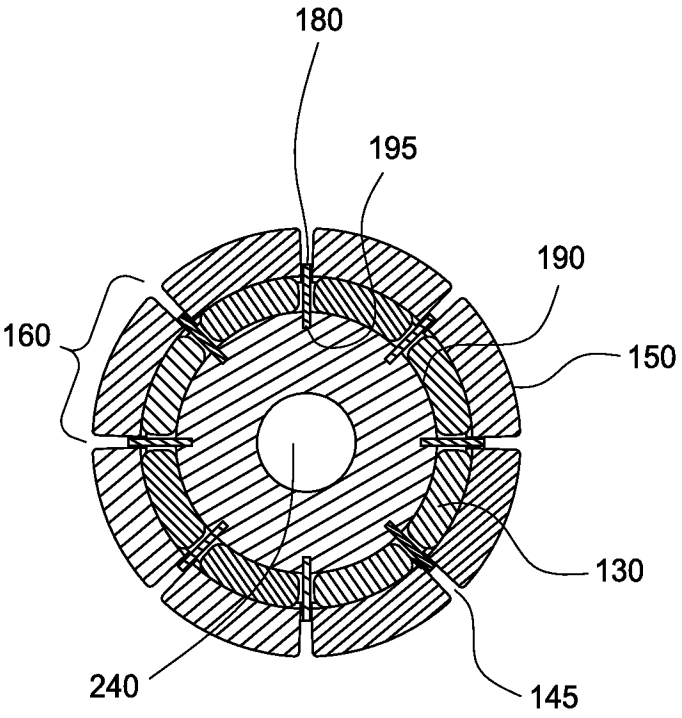
FIG. 3A is a section view taken along lines A-A on FIG. 3.

FIG. 3A is a section view taken along lines A-A on FIG. 3. As shown, the sides of the pocket 160 are defined by the fins 180 and the cone mandrel 190. The pockets 160 are equally spaced around the circumference of the cone mandrel 190. In another embodiment, the pockets may be unequally spaced around the circumference of the cone mandrel 190. Further, the compliant cone system 100 shown in FIG. 3A includes 8 pockets; however, there may be any number of pockets without departing from principles of the present invention, for example, 4, 6, or 10 pockets. The cone mandrel 190 may include a bore 240 to allow fluid or other material to move through the expansion assembly 200.

As shown in FIG. 3A, a groove 145 is present between the cone segments 150. As the compliant cone system 100 is pulled through the tubular to expand the tubular, these grooves 145 may cause a small wedge (lip) to form on the inside of the tubular. If the groove 145 between any two cone segments 150 is considerably large, it could cause the wedge in the tubular to be extruded to an extent that would defeat the expansion procedure, i.e., reduce the inner diameter of the expanded system. Thus, the width of the groove 145 should be as small as possible. In one embodiment, the groove 145 is designed to be 0.125 inch or less.

Figure 4A:
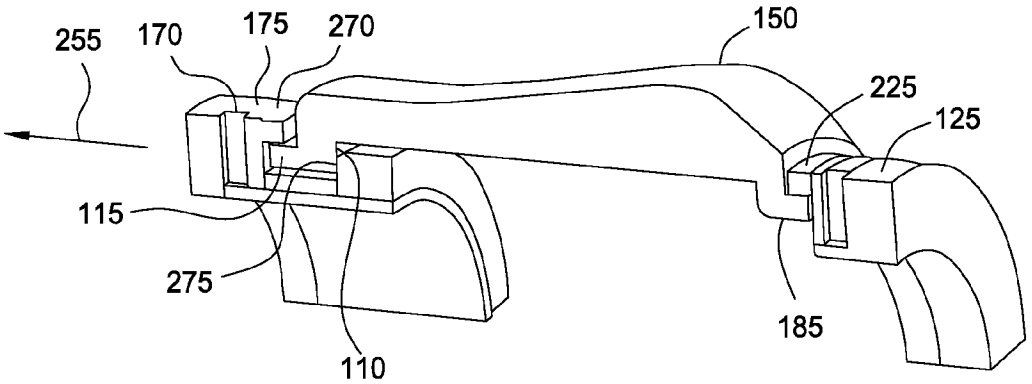
FIG. 4A is a view illustrating a cone segment of the compliant cone system.

FIG. 4A is a view illustrating a cone segment of the compliant cone system 100. To illustrate the relationship between the end members 125, 175 and the cone segment 150, the other components of the compliant cone system 100 are not shown. The cone segment 150 includes a first lip 185 and a second lip 115. The first lip 185 of the cone segment 150 is configured to interact with a lip portion 225 of the first end member 125 to ensure an end of the cone segment 150 is contained within the first end member 125. The second lip 115 of the cone segment 150 is configured to interact with a lip portion 270 of the second end member 175 to ensure an end of the cone segment 150 is contained within the second end member 175. The second lip 115 includes a shoulder 110 that engages a shoulder 275 on the second end member 175. As the compliant cone system 100 is urged in the direction indicated by arrow 255, the force applied to the second end member 175 is transmitted through the shoulders 110, 275 to the cone segment 150. As will be discussed in relation to FIGS. 5A and 5B, the cone segment 150 is substantially free floating in the compliant cone system 100. In other words, the cone segment 150 is free to move inside a controlled space defined by the end members 125, 175.

Figure 4B:
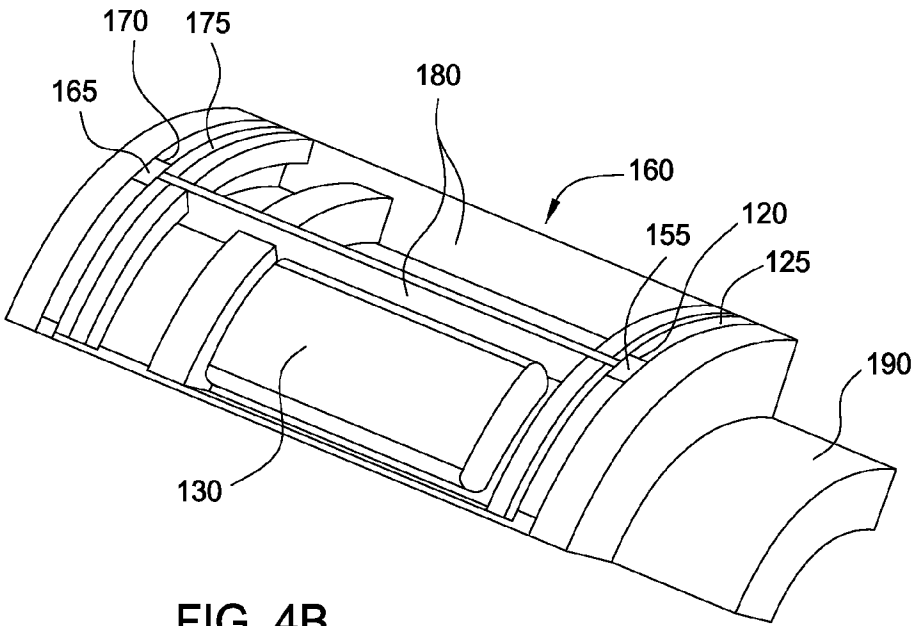
FIG. 4B is a view illustrating a biasing member in a pocket of the compliant cone system.

FIG. 4B is a view illustrating the biasing member 130 in the pocket 160 of the compliant cone system 100. The compliant cone system 100 moves between an original shape and a collapsed shape, as the compliant cone system 100 moves through the tubular. In other words, the compliance of the cone system 100 refers to the ability of the cone system 100 to change its outer diameter as the cone system 100 passes through restrictions and then to recover its outer diameter to the original size. The compliant cone system 100 must be capable of achieving the desired sealing function (i.e., while the compliant cone system 100 changes outer diameter as it passes through restrictions), but the level of compliance must not be large such that the compliant cone system 100 does not expand the tubular 25 to achieve the desired goal of sealing a troubled zone. The compliance of the compliant cone system 100 is achieved by a system in which the cone segment 150 is placed on top of the biasing member 130 that stores energy as the compliant cone system 100 passes through restrictions and then releasing that energy when the restriction is passed, thus allowing the compliant cone system 100 to regain its original outer diameter. In one embodiment, the biasing member 130 is a thick solid rubber shoe with a certain level of stiffness (rubber durometer measure). In another embodiment, the biasing member 130 could be other mechanisms such as high stiffness springs to store and release the energy. The biasing member 130 is selected in a manner in which the material can withstand repeated cycles of compression and decompression without loss of large energy storing capability. Also the biasing member 130 is selected such that it will not disintegrate due to the large loads and deformations. The dimensions of the biasing member 130 and other features (e.g., rounded corner radius) are optimized for each job through finite element analysis, although they share general characteristics. This shape and design of the biasing member 130 could be changed from the one shown in FIG. 4B to match job required functionality.

As shown in FIG. 4B, the pocket 160 is defined by fins 180, the cone mandrel 190 and the end members 125, 175. The biasing member 130 is configured to be placed in the pocket 160. In order for the biasing member 130 to be able to absorb the energy and release it when needed, the biasing member 130 must be contained in a pocket that limits its flowability. Due to the high compressive forces that would be encountered during the expansion operation, without a pocket, the biasing member 130 would be extruded and a loss of integrity of the biasing member 130 would occur. In this case, the biasing member 130 would lose its structural cohesion and therefore its ability to store and release energy. The pocket 160 may be designed to specific dimensions in order to give the biasing member 130 a certain area to expand, but not a large area to expand too much. During the expansion operation, the biasing member 130 changes shape as the volume of the pocket 160 changes due to radial movement of the cone segment 150.

As shown in FIG. 4B, the first end 155 of the fin 180 engages the groove 120 in the first end member 125 and the second end 165 of the fin 180 engages the groove 170 in the second end member 175. The fins 180, the cone mandrel 190 and the end members 125, 175 of the pocket 160 are designed to have a partial locking mechanism in order to control the release of energy of the biasing member 130. The arrangement of the pocket 160 allows for a certain amount of movement between the cone segment 150 and the end members 125, 175 (FIG. 4A) so the cone segment 150 can be compressed and released in a controlled manner. The arrangement of the pocket 160 also allows for an enclosure for the biasing member 130 so that the biasing member 130 does not disintegrate due to high compression.

FIGS. 5A to 9A illustrate the compliant cone system 100 expanding the tubular 25 disposed in the casing 10. As shown in these figures, the compliant cone system 100 moves between an original shape, a number of intermediate shapes, a collapsed shape and a final shape, as the compliant cone system 100 expands the tubular 25. Although the tubular 25 is shown in FIGS. 5A to 9A as being expanded in the casing 10, the tubular 25 may also be expanded into an open-hole wellbore (not shown) without departing from principles of the present invention.

Figure 5A:
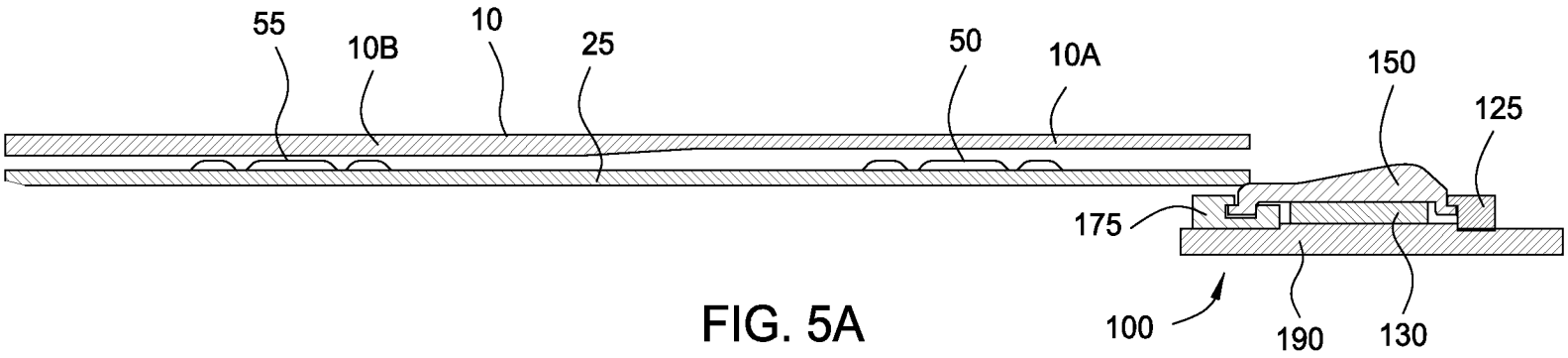
FIG. 5A is a view illustrating the compliant cone system prior to expansion of a tubular in a casing.

FIG. 5A is a view illustrating the compliant cone system 100 prior to expansion of a tubular 25. As shown, the tubular 25 is disposed in a casing 10. The casing 10 includes a first portion 10A that has an inner diameter greater than an inner diameter of a second portion 10B. The difference in diameter between the first portion 10A and the second portion 10B could be a result of tolerances in the casing 10, casing weight differences, rust buildup, scale buildup, or other types of restrictions of the inner diameter of the casing 10. The tubular 25 includes a first seal assembly 50 and a second seal assembly 55 that are positioned proximate the first portion 10A and the second portion 10B of the casing 10. Each seal assembly 50, 55 may include seal bands and/or anchors that are configured to engage the inner diameter of the casing 10. The seal assembly configuration, number of seals and seal material could vary based on the job requirement.

Figure 5B:
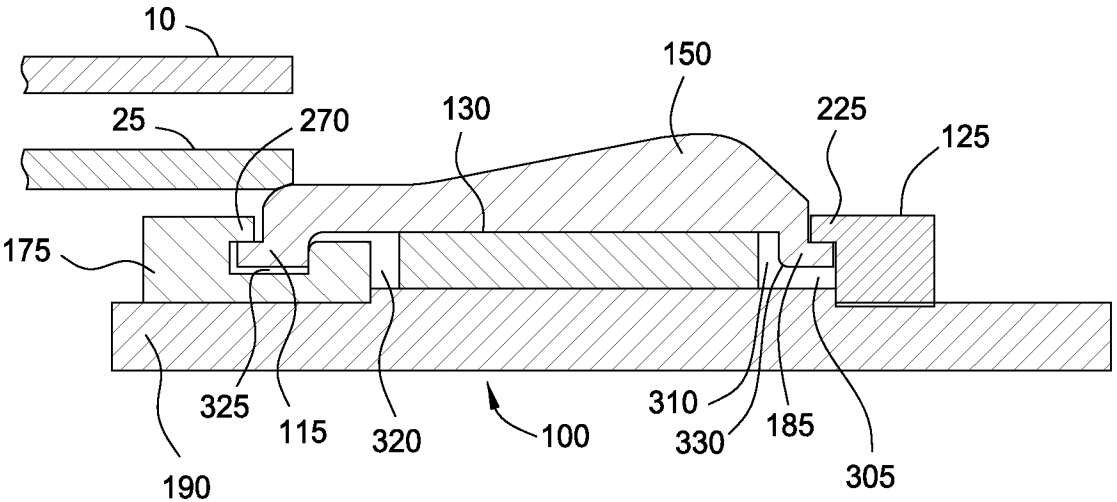
FIG. 5B is an enlarged view illustrating the compliant cone system shown in FIG. 5A.

FIG. 5B is an enlarged view illustrating the compliant cone system 100 shown in FIG. 5A. The compliant cone system 100 moves between an original shape and a collapsed shape, as the compliant cone system 100 moves through the tubular. For instance, as the compliant cone system 100 contacts the inner diameter of the tubular 25 during the expansion operation, one or more cone segments 150 may contract or move radially inward. After the expansion operation, the compliant cone system 100 may return to the original shape as the one or more cone segments 150 expand or move radially outward. The compliant cone system 100 may take any number of intermediate shapes as the compliant cone system 100 moves between the original shape and the collapsed shape. In the original shape, the compliant cone system 100 has a first diameter, and in the collapsed shape, the compliant cone system 100 has a second diameter that is smaller than the first diameter. The cone segment 150 is substantially a free-floating member in the compliant cone system 100. FIG. 5B illustrates the compliant cone system 100 in the original shape.

As shown in FIG. 5B, the first lip 185 of the cone segment 150 is disposed in a first lip chamber 305, and the second lip 115 of the cone segment 150 is disposed in a second lip chamber 325. The lips 185, 115 are configured to move within the respective chambers 305, 325 as the cone segment 150 moves relative to the end members 125, 175. As also shown in FIG. 5B, a first chamber 320 and a second chamber 310 are disposed on the sides of the biasing member 130. The biasing member 130 moves in the chambers 320, 310 as the cone segment 150 moves relative to the end members 125, 175. The lips 185, 115 are in the upper portion of the respective chamber 305, 325 when the compliant cone system 100 is in the original shape.

Figure 6A:
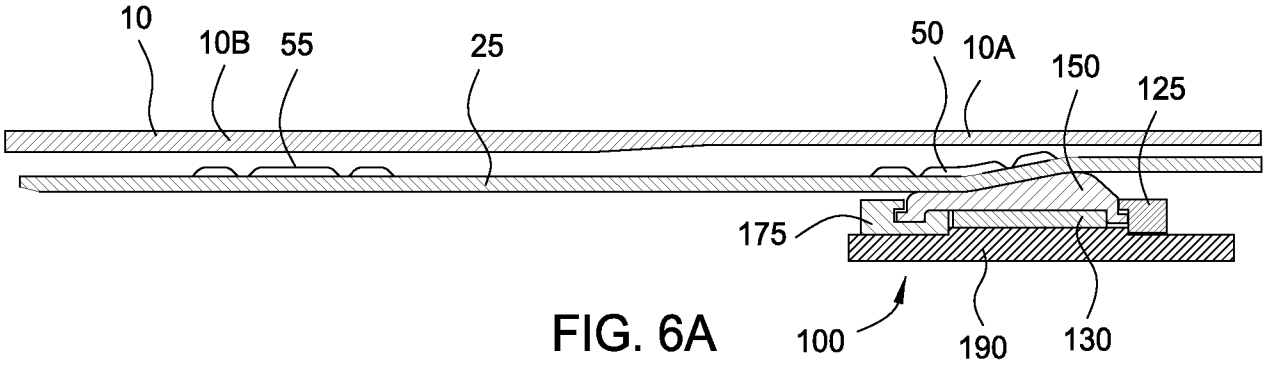
FIG. 6A is a view illustrating the compliant cone system during expansion of a first seal section on the tubular.

FIG. 6A is a view illustrating the compliant cone system 100 during expansion of the first seal section 50 on the tubular 25 in the first portion 10A of the casing 10. The compliant cone system 100 has expanded a portion of the tubular 25 in the casing 10. The cone system 100 is positioned proximate the first seal section 50 of the tubular 25 that is disposed in the first portion 10A of the casing 10. As set forth herein, the first portion 10A has an inner diameter greater than an inner diameter of a second portion 10B of the casing 10.

Figure 6B:
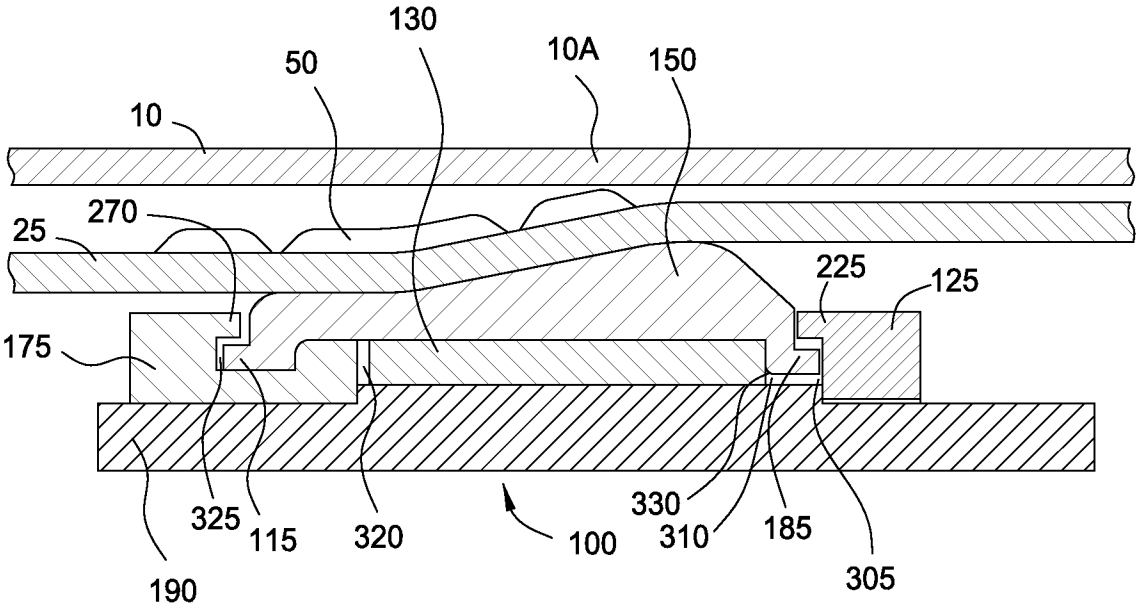
FIG. 6B is an enlarged view illustrating the compliant cone system shown in FIG. 6A.

FIG. 6B is an enlarged view illustrating the compliant cone system 100 shown in FIG. 6A. As shown, the compliant cone system 100 has moved from the original shape (FIG. 5B) to an intermediate shape (FIG. 6B). In the intermediate shape, the cone segment 150 has moved radially inward such that the first lip 185 of the cone segment 150 has moved into the chamber 305 and the second lip 115 of the cone segment 150 has moved to a lower position in the second chamber 325. In addition, the biasing member 130 has been compressed between the cone segment 150 and the cone mandrel 190, which causes the biasing member 130 to flow (or move) into the chambers 310, 320. As shown, the biasing member 130 has moved into the entire chamber 310 and is at the point of entering into the lip chamber 305 under the lip 185 of the cone segment 150. It is to be noted that the lip 185 includes a rounded edge 330 to substantially prevent the lip 185 from damaging or cutting the biasing member 130 as the lip 185 moves in the chamber 305. As the cone system 100 moves through the tubular 25, the cone system 100 is expanding the tubular 25 in a compliant manner.

Figure 7A:
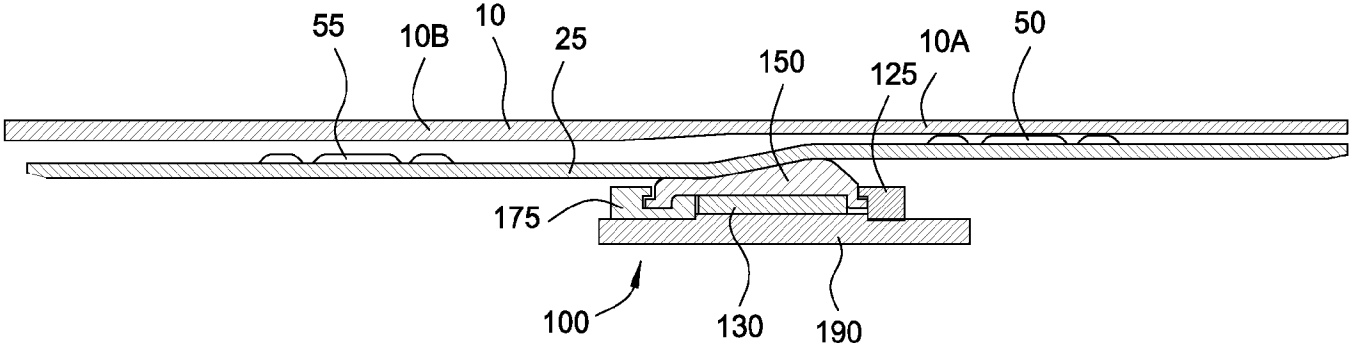
FIG. 7A is a view illustrating the compliant cone system during expansion of the tubular.

FIG. 7A is a view illustrating the compliant cone system 100 during expansion of the tubular 25. The compliant cone system 100 has expanded the first seal section 50 of the tubular 25 into engagement with the casing 10. The cone system 100 is positioned proximate the second portion 10B of the casing 10 which has a smaller inner diameter than the first portion 10A of the casing 10.

Figure 7B:
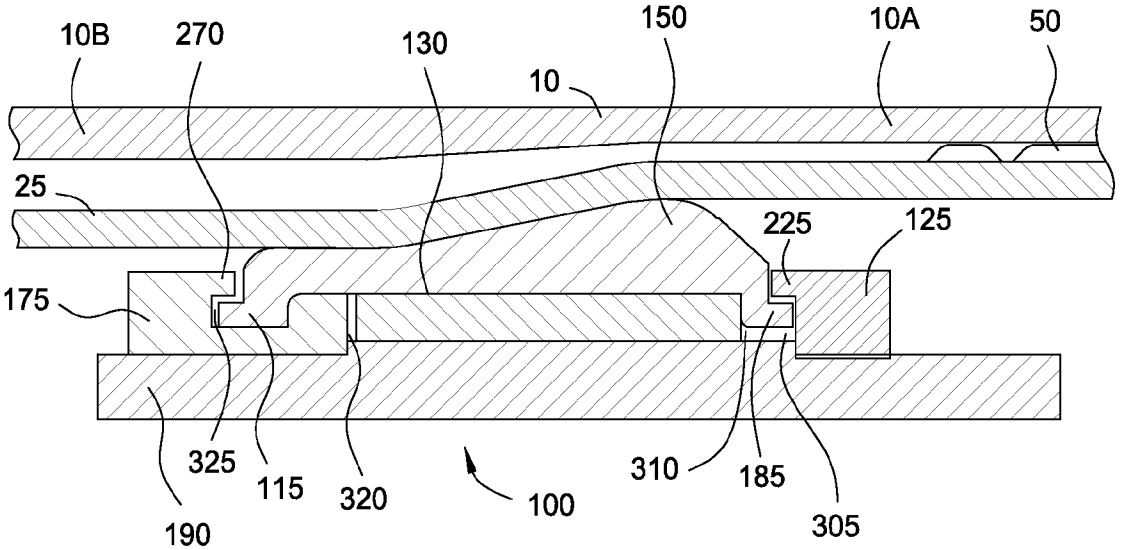
FIG. 7B is an enlarged view illustrating the compliant cone system shown in FIG. 7A.

FIG. 7B is an enlarged view illustrating the compliant cone system shown in FIG. 7A. As shown, the compliant cone system 100 is in another intermediate shape. The cone segment 150 has moved radially outward relative to the intermediate position shown in FIG. 6A such that the first lip 185 of the cone segment 150 has moved back through in the chamber 305. In addition, the biasing member 130 is compressed between the cone segment 150 and the cone mandrel 190 as the cone system 100 expands the tubular 25 in a compliant manner.

Figure 8A:
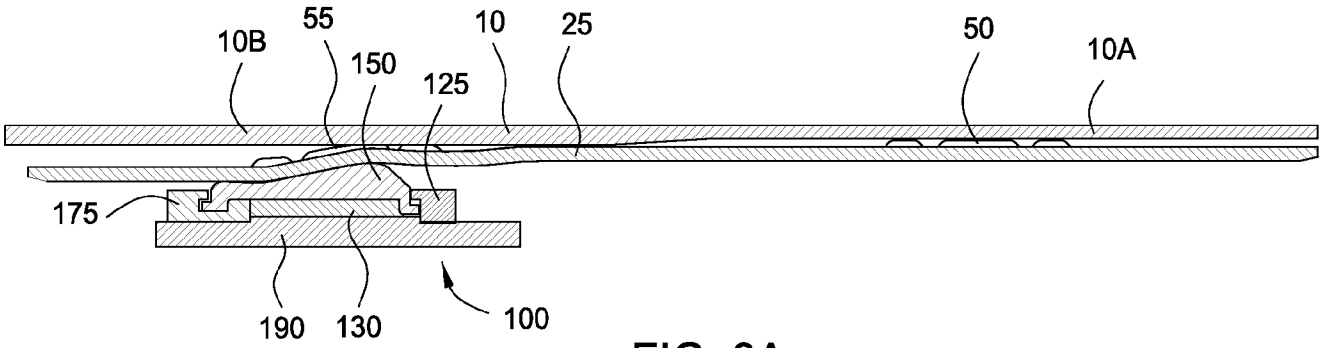
FIG. 8A is a view illustrating the compliant cone system during expansion of a second seal section on the tubular.

FIG. 8A is a view illustrating the compliant cone system 100 during expansion of the second seal section 50 on the tubular 25 in the second portion 10B of the casing 10. The compliant cone system 100 has expanded a portion of the tubular 25 between the seal sections 50, 55. The cone system 100 is positioned proximate the second seal section 55 of the tubular 25 that is disposed in the second portion 10B of the casing 10. As set forth herein, the second portion 10B has an inner diameter less than an inner diameter of the first portion 10A of the casing 10.

Figure 8B:
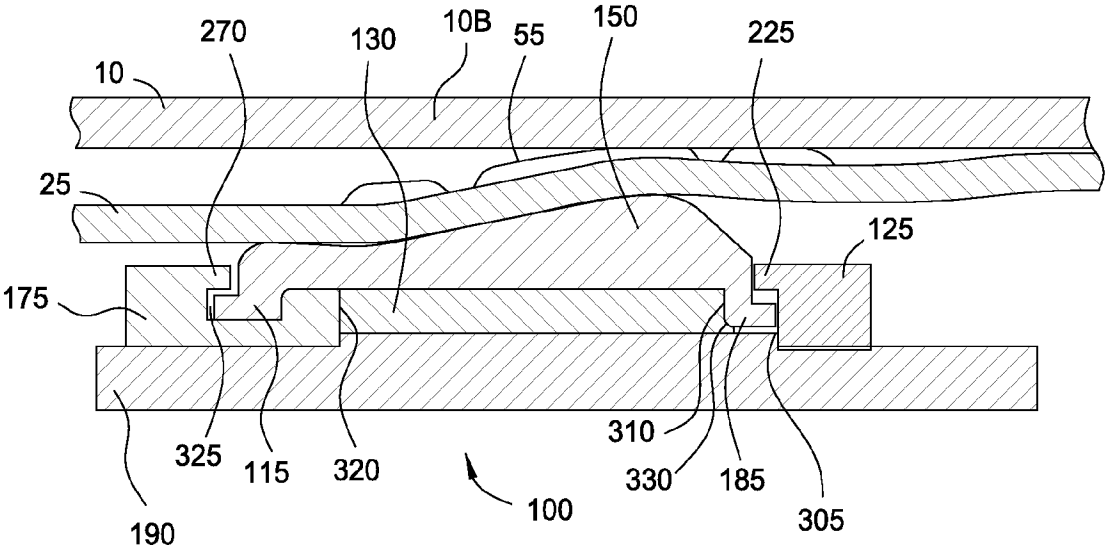
FIG. 8B is an enlarged view illustrating the compliant cone system shown in FIG. 8A.

FIG. 8B is an enlarged view illustrating the compliant cone system 100 shown in FIG. 8A. As shown, the compliant cone system 100 has moved from the original shape (FIG. 5B) to the collapsed shape (FIG. 8B). In the collapsed shape, the cone segment 150 has moved radially inward such that the first lip 185 of the cone segment 150 has moved into the chamber 305 and the second lip 115 of the cone segment 150 has moved to a lower position in the second chamber 325. In addition, the biasing member 130 has been compressed between the cone segment 150 and the cone mandrel 190, which causes the biasing member 130 to flow (or move) into the chambers 310, 320 such that the entire volume of the chambers 310, 320 are filled with the biasing member 130. The biasing member 130 has also entered into the lip chamber 305 under the lip 185 of the cone segment 150. The rounded edge 330 of lip 185 allows the biasing member 130 to move into the chamber 305 and under the lip 185 without damaging or cutting the biasing member 130.

Figure 9A:
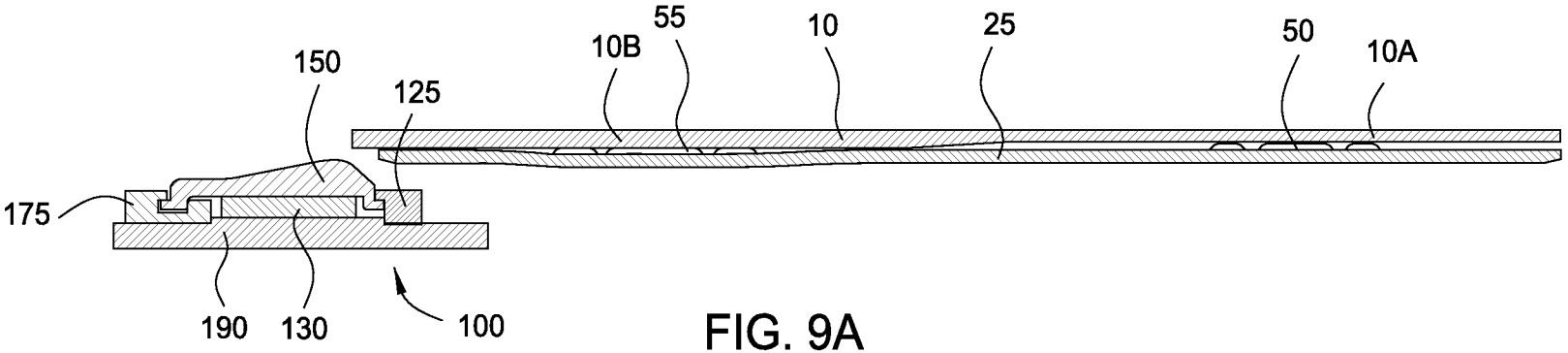
FIG. 9A is a view illustrating the compliant cone system after expansion of the tubular in the casing.

FIG. 9A is a view illustrating the compliant cone system 100 after expansion of the tubular 25 in the casing 10. As shown, the first seal assembly 50, the second seal assembly 55 and other portions of the tubular 25 are in contact with the inner diameter of the casing 10.

Figure 9B:
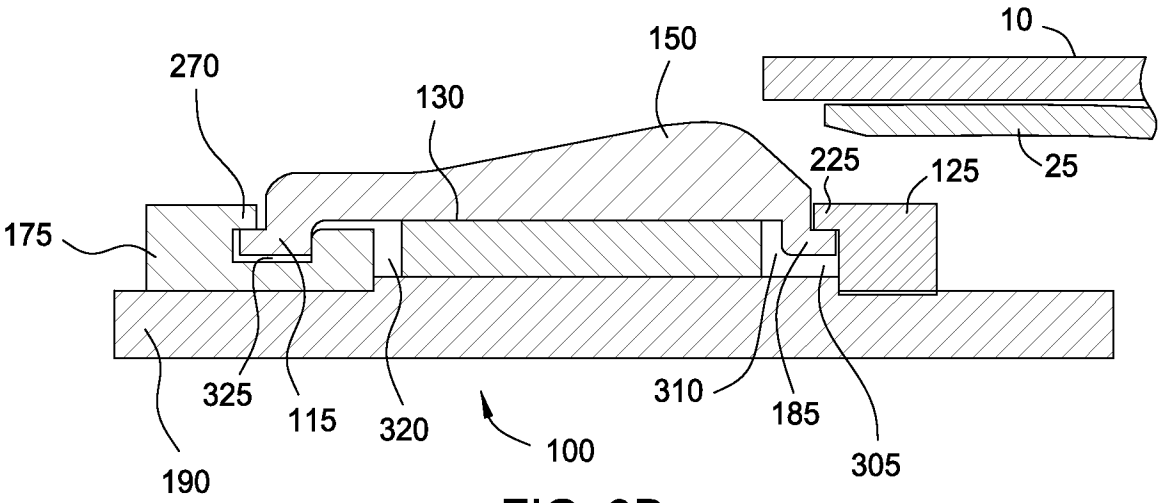
FIG. 9B is an enlarged view illustrating the compliant cone system shown in FIG. 9A.

FIG. 9B is an enlarged view illustrating the compliant cone system 100 shown in FIG. 9A. As shown, the compliant cone system 100 has moved back to the original shape (or final shape). During the expansion operation, the compliant cone system 100 has moved from the original position (FIG. 5B), intermediate positions (FIGS. 6B, 7B), collapsed position (FIG. 8B) and back to the original position (FIG. 9B). As shown, the first lip 185 of the cone segment 150 has moved in the chamber 305 such that the first lip 185 is in contact with the lip portion 225 of the first end member 125 and the second lip 115 of the cone segment 150 has moved in the second lip chamber 325 such that the second lip 185 is in contact with the lip portion 270 of the second end member 175. The biasing member 130 has moved out of the chambers 320, 310. At this point, the compliant cone system 100 may be used to expand another tubular or any number of tubulars in a similar manner as set forth in FIGS. 5A-9A.

Figure 10:
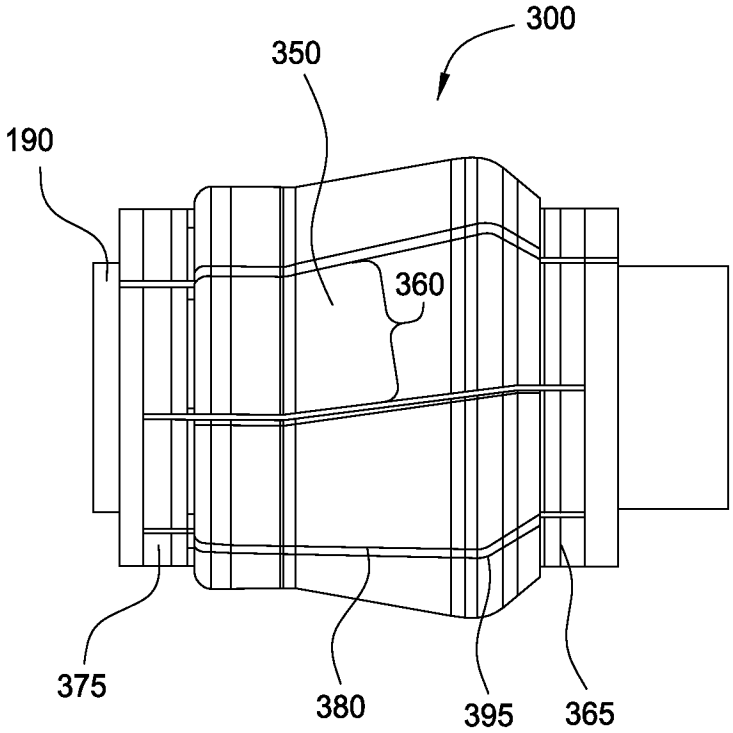
FIG. 10 is a view illustrating a compliant cone system of the expansion assembly according to one embodiment of the invention.

FIG. 10 is a view illustrating a compliant cone system 300 of the expansion assembly according to one embodiment of the invention. For convenience, the components in the compliant cone system 300 that are similar to the compliant cone system 100 will be labeled with the same reference indicator. As shown, the compliant cone system 300 includes a first end member 365 and a second end member 375 disposed around the cone mandrel 190. The compliant cone system 300 also includes a plurality of cone segments 350 that are configured to move radially relative to the end members 365, 375. Each cone segment 350 is disposed in a pocket 360 that is positioned at an angle relative to a longitudinal axis of the compliant cone system 300. The pocket 360 is separated from another pocket by curved fins 380. One difference between the compliant cone system 300 and the compliant cone system 100 is that the fins 380 and the edges of the cone segments 350 are curved. In other words, the cone segments 350 are manufactured by performing an angled cut of the cone segments 350. In contrast, the edges of the cone segments 150 in the compliant cone system 100 are substantially straight. The biasing member (not shown) may also have curved edges. In another embodiment, the biasing member may have straight edges and the biasing member is rotated at an angle relative to the longitudinal axis of the compliant cone system 300. One benefit of the compliant cone system 300 is that a groove 385 between the cone segments 350 is at an angle relative to the longitudinal axis of the compliant cone system 300 (compare groove 145 on FIGS. 3, 3A and groove 385). Thus, as the compliant cone system 300 is pulled through the tubular, the wedges (lips) that are formed by the front grooves in the inner surface of the tubular are ironed and smoothed by the advancing cone segments 350, and thus eliminated, or reduced. The compliant cone system 300 may be attached to the connection member to connect the expansion assembly to a work string (not shown). The compliant cone system 300 may be used to expand a tubular in a similar manner as set forth herein.

In one embodiment, an expansion cone system is provided. The expansion cone system includes a mandrel and two or more pockets disposed circumferentially around the mandrel. Each pocket is at least partially defined by a fin member. The expansion cone system further includes a cone segment coupled to each pocket. Additionally, the expansion cone system includes a biasing member disposed between the mandrel and the respective cone segment.

In one or more of the embodiments described herein, a first end member and a second end member is disposed at each end of the cone segment.

In one or more of the embodiments described herein, the sides of each pocket are defined by the fin member, the first end member, the second end member and the mandrel.

In one or more of the embodiments described herein, each fin member includes a first end configured to engage a groove in the first end member and a second end configured to engage a groove in the second end member.

In one or more of the embodiments described herein, each fin member includes a lower end configured to engage a groove in the mandrel.

In one or more of the embodiments described herein, the plurality of cone segments are movable between an original shape having a first outer diameter and a collapsed shape having a second outer diameter smaller than the first outer diameter.

In one or more of the embodiments described herein, the biasing members bias the cone segments to the original shape.

In one or more of the embodiments described herein, each cone segment is independently movable relative to the first end member and the second end member.

In one or more of the embodiments described herein, each cone segment is contained in the pocket by a lip on the first end member and a lip on the second end member.

In one or more of the embodiments described herein, the plurality of cone segments is configured to move in a radial direction relative to the first end member and the second end member.

In one or more of the embodiments described herein, the fin member is configured to separate adjacent pockets.

In one or more of the embodiments described herein, each cone segment is independently movable relative to each other.

In one embodiment, a method of expanding a wellbore tubular is provided. The method includes the step of positioning an expansion cone system in the wellbore tubular, wherein the expansion cone system comprises two or more pockets disposed circumferentially around a mandrel, and a biasing member and a cone segment disposed in each pocket. The method further includes the step of expanding a portion of the wellbore tubular by utilizing the cone segment of the expansion cone system in a first configuration. The method also includes the step of encountering a restriction to expansion which causes the cone segment of the expansion cone system to deform the biasing member and change into a second configuration. Additionally, the method includes the step of expanding another portion of the wellbore tubular by utilizing the cone segment in the second configuration.

In one or more of the embodiments described herein, the method includes the step of encountering a second restriction in the wellbore tubular which causes the cone segments of the expansion cone system to further deform the biasing member and change into a third configuration.

In one or more of the embodiments described herein, the method includes the step of moving the cone segments of the expansion cone system from the third configuration to the second configuration and expanding a further portion of the wellbore tubular by utilizing the cone segments in the second configuration.

In one or more of the embodiments described herein, each biasing member is configured to move each cone segment of the expansion cone system from the third configuration to the second configuration.

In one or more of the embodiments described herein, each pocket is at least partially defined by a fin member.

In one embodiment, an expansion cone for expanding a tubular is provided. The expansion cone system includes two or more pockets disposed circumferentially around a mandrel. Each pocket is configured to contain an energy absorbing mechanism, wherein each energy absorbing mechanism is separated by a fin member. The expansion cone system further includes a cone segment that interacts with each pocket. Each cone segment is individually movable in the pocket between an original shape and a collapsed shape, wherein the expansion cone has a first diameter when the cone segment is in the original shape and a second diameter that is smaller than the first diameter when the cone segment is in the collapsed shape.

In one or more of the embodiments described herein, the energy absorbing mechanism biases the cone segments to the original shape.

In one embodiment, an expansion cone system for expanding a tubular is provided. The expansion cone system includes a mandrel and a plurality of fin members disposed circumferentially around the mandrel. The expansion cone system further includes a cone segment disposed between two fin members. Additionally, the expansion cone system includes an energy absorbing member disposed between the mandrel and the respective cone segment.

In another embodiment, an expansion cone system includes a mandrel; a cone segment; a plurality of fin members disposed circumferentially around the mandrel; and an energy absorbing member disposed between the mandrel and the cone segment and between two adjacent fin members, wherein expansion of the energy absorbing member is constrained by the two adjacent fin members.

In yet another embodiment, an expansion cone for expanding a tubular includes a mandrel; two or more pockets disposed circumferentially around the mandrel, each pocket configured to contain an energy absorbing mechanism; and a cone segment that interacts with the energy absorbing mechanism, each cone segment being individually movable between an initial shape where the expansion cone has a first diameter, and a collapsed shape where the expansion cone has a smaller, second diameter.

While the foregoing is directed to embodiments of the present invention, other and further embodiments of the invention may be devised without departing from the basic scope thereof, and the scope thereof is determined by the claims that follow.

The invention claimed is:

1. An expansion cone system comprising:

a mandrel;

two or more pockets disposed circumferentially around the mandrel, each pocket is at least partially defined by a fin member;

a cone segment coupled to each pocket;

a first end member and a second end member disposed at each end of the cone segment, wherein each cone segment is independently movable relative to the first end member and the second end member; and a biasing member disposed in each pocket between the mandrel and the respective cone segment.

2. The expansion cone system of claim 1, wherein each side of each pocket is defined by one of the fin member, the first end member, the second end member and the mandrel.

3. The expansion cone system of claim 1, wherein each fin member includes a first end configured to engage a groove in the first end member and a second end configured to engage a groove in the second end member.

4. The expansion cone system of claim 1, wherein each fin member includes a lower end configured to engage a groove in the mandrel.

5. The expansion cone system of claim 1, wherein the plurality of cone segments are movable between an original shape having a first outer diameter and a collapsed shape having a second outer diameter smaller than the first outer diameter.

6. The expansion cone system of claim 5, wherein the biasing members bias the cone segments to the original shape.

7. The expansion cone system of claim 1, wherein each cone segment is contained in the pocket by a lip on the first end member and a lip on the second end member.

8. The expansion cone system of claim 1, wherein the plurality of cone segments is configured to move in a radial direction relative to the first end member and the second end member.

9. The expansion cone system of claim 1, wherein the fin member is configured to separate adjacent pockets.

10. The expansion cone system of claim 1, wherein each cone segment is independently movable relative to each other.

11. A method of expanding a wellbore tubular, the method comprising:

positioning an expansion cone system in the wellbore tubular, wherein the expansion cone system comprises:

two or more pockets disposed circumferentially around a mandrel, wherein each pocket is at least partially defined by a fin member, a biasing member and a cone segment disposed in each pocket, and a first end member and a second end member disposed at each end of the cone segment, wherein each cone segment is independently movable relative to the first end member and the second end member;

expanding a portion of the wellbore tubular by utilizing the cone segments of the expansion cone system in a first configuration;

encountering a restriction to expansion which causes the cone segments of the expansion cone system to deform the biasing member and change into a second configuration; and expanding another portion of the wellbore tubular by utilizing the cone segments in the second configuration.

12. The method of claim 11, further comprising encountering a second restriction in the wellbore tubular which causes the cone segments of the expansion cone system to further deform the biasing member and change into a third configuration.

13. The method of claim 12, further comprising moving the cone segments of the expansion cone system from the third configuration to the second configuration and expanding a further portion of the wellbore tubular by utilizing the cone segments in the second configuration.

14. The method of claim 13, wherein each biasing member is configured to move each cone segment of the expansion cone system from the third configuration to the second configuration.

15. An expansion cone for expanding a tubular, comprising:

two or more pockets disposed circumferentially around a mandrel, each pocket configured to contain an energy absorbing mechanism, wherein each energy absorbing mechanism is separated by a fin member;

a cone segment that interacts with each pocket, each cone segment being individually movable in the pocket between an original shape and a collapsed shape, wherein the expansion cone has a first diameter when the cone segment is in the original shape and a second diameter that is smaller than the first diameter when the cone segment is in the collapsed shape; and a first end member and a second end member disposed at each end of the cone segment, wherein each cone segment is independently movable relative to the first end member and the second end member.

16. The expansion cone of claim 15, wherein the energy absorbing mechanism biases the cone segments to the original shape.

17. The expansion cone of claim 15, wherein the first end member and the second end member are configured to hold each cone segment within the respective pocket.

18. The expansion cone of claim 17, wherein each pocket is defined by the fin member, the first end member, the second end member and the mandrel.

19. The expansion cone of claim 17, wherein one end of each fin member is connected to the first end member and another end of each fin member is connected to the second end member.

20. An expansion cone system comprising:

a mandrel;

a plurality of fin members disposed circumferentially around the mandrel;

a cone segment disposed between two adjacent fin members, wherein the cone segment is disposed in a pocket at least partially defined by the two adjacent fin members;

a first end member and a second end member disposed at each end of the cone segment, wherein the cone segment is independently movable relative to the first end member and the second end member; and an energy absorbing member disposed between the mandrel and the cone segment, wherein the energy absorbing member is elastic.

21. The system of claim 20, wherein expansion of the energy absorbing member is constrained by the two adjacent fin members.

22. An expansion cone system comprising:

a mandrel;

cone segments;

a first end member and a second end member disposed at each end of the cone segments, wherein each cone segment is independently movable relative to the first end member and the second end member;

a plurality of fin members disposed circumferentially around the mandrel; and an energy absorbing member disposed between the mandrel and the cone segments, and between two adjacent fin members, wherein expansion of the energy absorbing member is constrained by the two adjacent fin members.

23. An expansion cone for expanding a tubular, comprising:

a mandrel;

two or more pockets disposed circumferentially around the mandrel, each pocket configured to contain an energy absorbing mechanism;

a cone segment that interacts with the energy absorbing mechanism, each cone segment being individually movable between an initial shape where the expansion cone has a first diameter, and a collapsed shape where the expansion cone has a smaller, second diameter; and a first end member and a second end member disposed at each end of the cone segment, wherein each cone segment is independently movable relative to the first end member and the second end member.

24. An expansion cone system comprising:

a mandrel;

two or more pockets disposed circumferentially around the mandrel, each pocket is at least partially defined by a fin member;

a cone segment coupled to each pocket;

a first end member and a second end member disposed at each end of the cone segment, wherein each fin member includes a first end configured to engage a groove in the first end member and a second end configured to engage a groove in the second end member; and a biasing member disposed in each pocket between the mandrel and the respective cone segment.

25. An expansion cone system comprising:

a mandrel;

two or more pockets disposed circumferentially around the mandrel, each pocket is at least partially defined by a fin member, wherein each fin member includes a lower end configured to engage a groove in the mandrel;

a cone segment coupled to each pocket;

a first end member and a second end member disposed at each end of the cone segment; and a biasing member disposed in each pocket between the mandrel and the respective cone segment.

26. An expansion cone system comprising:

a mandrel;

two or more pockets disposed circumferentially around the mandrel, each pocket is at least partially defined by a fin member;

a cone segment coupled to each pocket;

a first end member and a second end member disposed at each end of the cone segment, wherein the plurality of cone segments is configured to move in a radial direction relative to the first end member and the second end member; and a biasing member disposed in each pocket between the mandrel and the respective cone segment.

* * * * *